US008770206B2

(12) United States Patent
Le Roux

(10) Patent No.: US 8,770,206 B2
(45) Date of Patent: Jul. 8, 2014

(54) FLOW CONTROL DEVICE FOR A SMOKING ARTICLE

(75) Inventor: Gerhard Malan Le Roux, Paarl (ZA)

(73) Assignee: Tobacco Research and Development Institute (Proprietary) Limited, Stellenbosch (ZA)

( * ) Notice: Subject to any disclaimer, the term of this patent is extended or adjusted under 35 U.S.C. 154(b) by 0 days.

(21) Appl. No.: 13/504,901

(22) PCT Filed: Oct. 15, 2010

(86) PCT No.: PCT/EP2010/065536

§ 371 (c)(1),
(2), (4) Date: Jul. 17, 2012

(87) PCT Pub. No.: WO2011/051115

PCT Pub. Date: May 5, 2011

(65) Prior Publication Data

US 2012/0272977 A1 Nov. 1, 2012

(30) Foreign Application Priority Data

Oct. 28, 2009 (ZA) ..... 2009/07582

(51) Int. Cl.
*A24D 3/04* (2006.01)
*A24B 15/00* (2006.01)
*A24D 3/06* (2006.01)

(52) U.S. Cl.
USPC ..... 131/335; 131/331; 131/336; 131/338

(58) Field of Classification Search
None
See application file for complete search history.

(56) References Cited

U.S. PATENT DOCUMENTS 2,954,035 A 9/1960 Saffir
3,428,050 A 2/1969 Kandel
3,630,210 A * 12/1971 Haslam ..... 131/338

(Continued)

FOREIGN PATENT DOCUMENTS

EP 0317154 A1 5/1989
FR 2873899 A1 2/2006

OTHER PUBLICATIONS

International Preliminary Report on Patentability, mailed May 10, 2012, for PCT International Application No. PCT/EP2010/065536, filed Oct. 15, 2010.

(Continued)

*Primary Examiner* — Richard Crispino
*Assistant Examiner* — Phu Nguyen
(74) *Attorney, Agent, or Firm* — N W Poulsen; L A Pinol

(57) ABSTRACT

A smoking article such as a filter cigarette includes a rotary flow control device (2) in its filter assembly that comprises first, second and third body portions (3, 4, 5). The first body portion (1) contains a plug (6) of filter material and is attached to a tobacco rod (1). The second portion (4) contains different smoke flavorants in different sectors (18), which can be aligned by manual rotation individually with a smoke flow passageway (13, 35) to impart different flavors to the smoke that passes to the mouth of the consumer. The second body portion (4) is rotated through the agency of the third body portion (5). First and second ratchet mechanisms (14,19; 20, 24) are disposed between the second body portion (4) and the first and third body portions respectively to allow assured rotation of the second portion to select individual flavorants for the smoke passing to the consumer.

14 Claims, 4 Drawing Sheets

(56) References Cited

U.S. PATENT DOCUMENTS

| | | | | | |
|---|---|---|---|---|---|
| 3,874,393 | A | * | 4/1975 | Strong | 131/193 |
| 4,382,520 | A | * | 5/1983 | Aleff | 215/21 |
| 4,677,995 | A | * | 7/1987 | Kallianos et al. | 131/335 |
| 4,700,725 | A | | 10/1987 | Geiszler | |
| 2008/0051707 | A1 | * | 2/2008 | Phan et al. | 604/108 |

OTHER PUBLICATIONS

International Search Report and Written Opinion, mailed Feb. 2, 2011, for PCT International Application No. PCT/EP2010/065536, filed Oct. 15, 2010.

* cited by examiner

FLOW CONTROL DEVICE FOR A SMOKING ARTICLE

CLAIM FOR PRIORITY

This application is a National Stage Entry entitled to and hereby claims priority under 35 U.S.C. §§365 and 371 to corresponding PCT Application No. PCT/EP2010/065536, filed Oct. 15, 2010, which in turn claims priority to South African Application Serial No. ZA 2009/07582, filed Oct. 28, 2009. The entire contents of the aforementioned applications are herein expressly incorporated by reference.

FIELD OF THE INVENTION

This invention relates to a flow control device for a smoking article which may be used to modify a gaseous flow such as smoke supplied to a consumer.

BACKGROUND

It is known from EP 0317154A and U.S. Pat. No. 4,677,995 to provide filters for cigarettes which include a rotatable filter segment having two smoke flow paths containing different flavourant materials, that can be rotated to select different paths through which smoke travels to the consumer. This enables the user to select a flavourant or different levels of filtering, in dependence on the angle of rotation of the filter segment.

SUMMARY OF THE INVENTION

According to the present invention, there is provided a flow control device for a smoking article comprising an elongate body having first and second body portions rotatable relative to one another about a common axis and having a gaseous flow passageway to allow gas to flow through the body, the body portions being configured to make a modification to gas flow along the passageway dependent upon the relative angle of rotation of the body portions about the axis, and a ratchet mechanism associated with the first and second body portions for controlling manual rotation of the first and second body portions relative to one another about the axis to provide a selected gas flow modification.

The ratchet mechanism may allow unidirectional rotation of the body portion relative to one another and may produce a succession of audible clicking sounds during rotation. This enables the consumer to check the angle of rotation of the body portions. Each of the clicking sounds may denote rotation of the body portions through a predetermined angle.

The second body portion may include different sectors configured to produce at least one different gas flow modification along the passageway. The gas flow modification may comprise a modification of the flavour thereof. The different sectors of the second body portion may contain different flavourants for tobacco smoke such as to provide a gas flow modification by modifying the flavour of tobacco smoke. The sectors may comprise quadrants, three of which may contain respective different flavourants and the fourth may contain no flavourant in order to provide an unflavoured option for the smoke passing through the passageway to the consumer.

The device may include third body portion rotatable relative to the first and second body portions with a gas flow passageway to allow the gas flow to pass through the third portion, and a ratchet mechanism to allow manual rotation of the third body portion relative to the second body portion. The ratchet mechanisms may allow unidirectional rotation of the second body portion relative to the first body portion with a first hand of rotation and unidirectional rotation of the third portion relative to the second portion with a second opposite hand of rotation. In this way, the third body portion can be used to rotate the second body portion relative to the first body portion to select different sectors of the second portion to modify the gas flow selectively.

A smoking article filter, for example a plug of cellulose acetate material, may be received in the first body portion or the third body portion. A tobacco rod may be coupled to the first body portion.

The or each ratchet mechanism may comprise cooperating peripheral teeth and recesses formed in the body portions.

The flow device according to the invention may be used in smoking articles that may comprise smokable products such as cigarettes, cigars and cigarillos whether based on tobacco, tobacco derivatives, expanded tobacco, reconstituted tobacco or tobacco substitutes, heat-not-burn products and other nicotine delivery systems such as aerosol delivery devices that deliver a generally gaseous flow to the consumer.

BRIEF DESCRIPTION OF THE DRAWINGS

The invention will now be described by way of illustrative example with reference to the accompanying drawings, in which.

DETAILED DESCRIPTION

Figure 1:
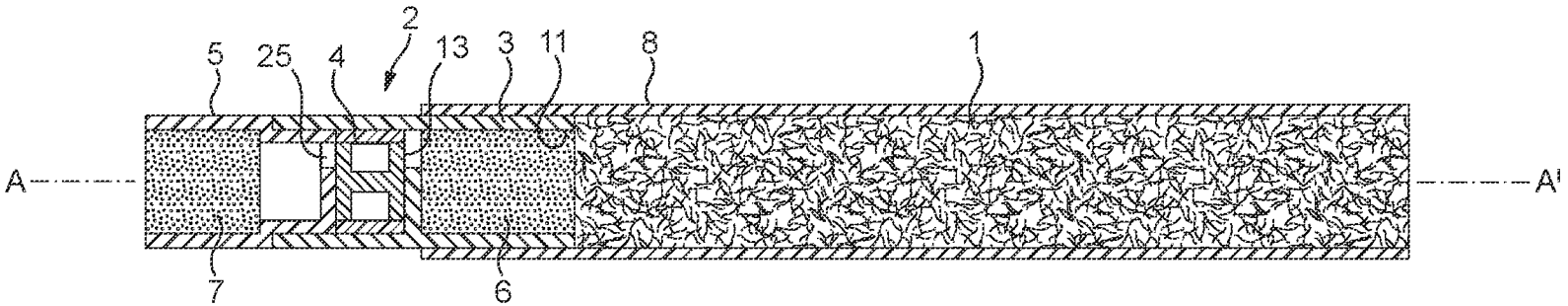
FIG. 1 is a schematic cross sectional view of a cigarette with a filter that contains a flow control device.
Figure 2:
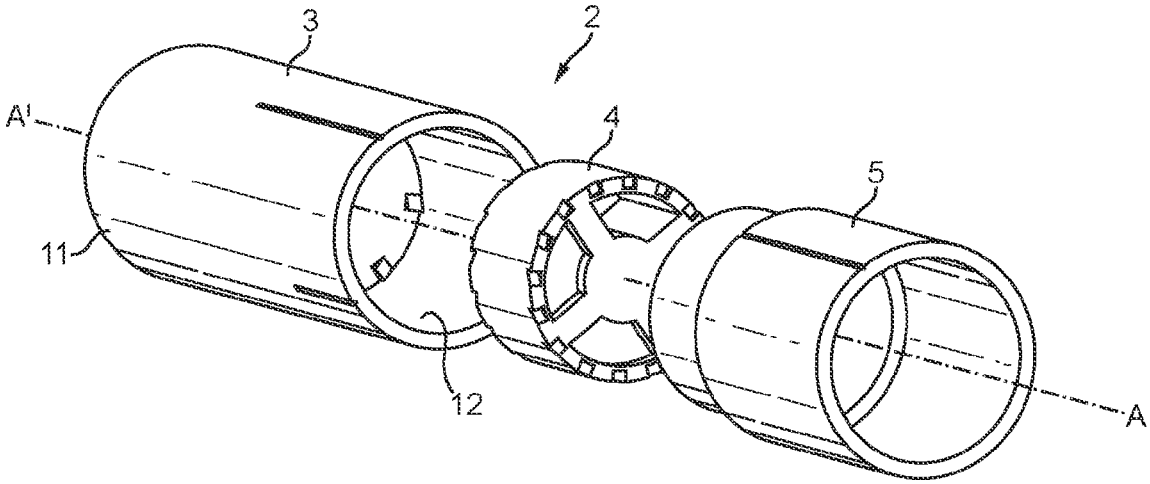
FIG. 2 is a schematic exploded, perspective view of the flow control device illustrated in FIG. 1.

Referring to FIG. 1, a smoking article in the form of a cigarette comprises a tobacco rod 1 that abuts a filter unit including a flow control device 2 that comprises a first, generally tubular body portion 3 abutting the tobacco rod 1, the body portion 3 containing a second, middle body portion 4. A third, rotary, mouth end body portion 5 abuts the second body portion 4. The body portions 3, 4, 5 are generally tubular, coaxial and may be formed of moulded plastics material. The filter unit also includes plugs of filter material 6, 7, conveniently cellulous acetate material fitted into opposite ends of the flow control device 2.

Figure 3:
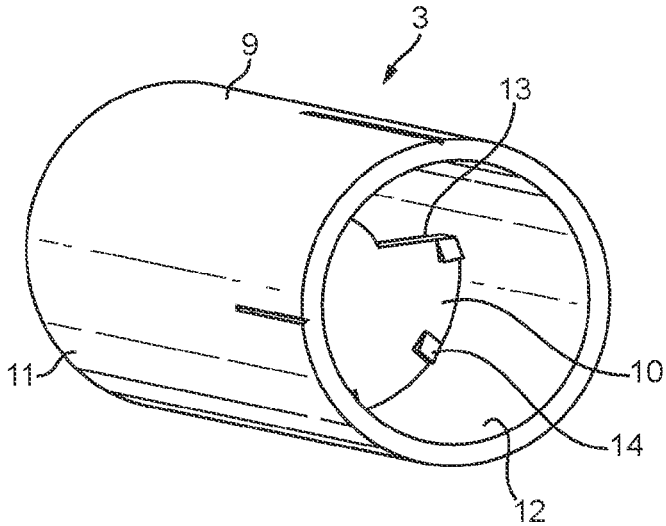
FIG. 3 is a more detailed view of a first, tobacco end body portion of the device illustrated in FIG. 2.

The flow control device 2 is illustrated in more detail in FIGS. 2-5, with the filter plugs 6, 7 and tobacco rod 1 omitted. The first body portion 3 may be of diameter corresponding to a conventional cigarette so that the tobacco rod 1 in FIG. 1 can be attached to the body portion 3 by a paper wrap 8 illustrated in FIG. 1. Referring to FIG. 3, the first body portion 3 has a tubular outer wall 9 and a diametrically extending inner bulkhead wall 10 that divides the body portion 3 into a distal chamber 11 that receives the filter plug 6 illustrated in FIG. 1, and a proximal chamber 12 that receives the second body portion 4 illustrated in FIG. 2. The wall 10 has a cut out portion that provides an air flow passageway 13 from the chamber 11 into chamber 12 to allow gaseous flow i.e. smoke to flow from the tobacco rod 1, through the plug 6 to the second body portion in chamber 12.

The wall 10 is provided with circumferential wedge-shaped teeth 14 that form part of a first ratchet mechanism that controls rotation of the second body portion 4.

Figure 4:
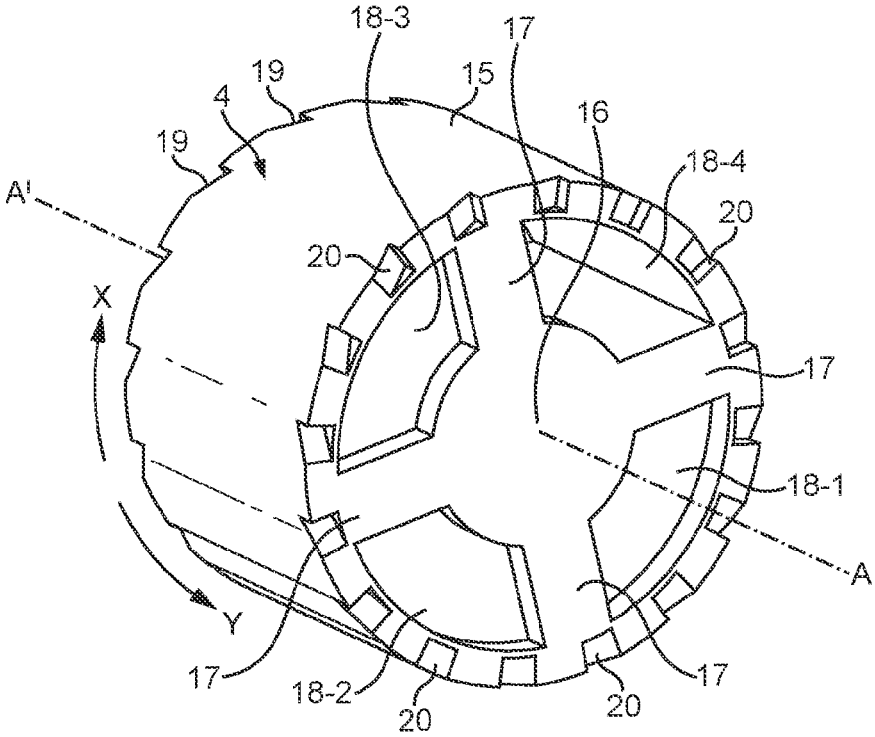
FIG. 4 is an enlarged perspective view of a second, middle body portion illustrated in FIG. 2 with sectors containing different flavourant.

The second body portion 4 is illustrated in more detail in FIG. 4 and comprises a cylindrical outer wall 15, a central, axial portion 16 and a plurality of radial arms 17, in this case four such arms, which divide the interior of the body portion 4 into sectors, in this case quadrants 18-1, 18-2, 18-3, 18-4. In alternative examples of the invention, two, three or more than four sectors can be provided.

The quadrants 18-1, 18-2, 18-3 are each filled with a different flavourant on a porous, smoke permeable matrix such as cellulose acetate, suitable for flavouring smoke. The quadrant 18-4 however provides an open passageway, with no flavourant. In other examples of the invention, the quadrant 18-4 could contain a similar smoke permeable matrix to that used in other quadrants 18-1, 18-2, 18-3, but without including any flavourant, such that the draw resistance for each of the quadrants 18-1 to 18-4 is substantially uniform. The individual quadrants 18 can be aligned by rotation of the second body portion 4 relative to the first body portion 3 about longitudinal, central axis A-A' so as to align the individual quadrants 18 with the gas flow passageway 13 for smoke from the tobacco rod 1.

The distal end of wall 15 is provided with circumferential, wedge-shaped recesses 19 that cooperate with the wedged-shaped teeth 14 illustrated in FIG. 3 on the wall 10 of the first body portion 3 such that the second body portion can be rotated unidirectionally relative to the first body portion in the direction of arrow X illustrated in FIG. 4. The recesses 19 and teeth 14 thereby define a first ratchet mechanism that allows the individual quadrants 18 to be aligned in the gas flow passageway provided by the cut out portion 13. The ratchet mechanism may produce an audible clicking sound each time the teeth 14 drop into the recesses 19. In one example, four such clicks are produced each time the second body portion 4 is rotated through 90° to align the next quadrant 18 with the cut out portion 13.

The second body portion 4 also includes peripheral recesses 20 at its proximal end that cooperate with the third body portion 5 to form a second ratchet mechanism as will now be described.

Figure 5:
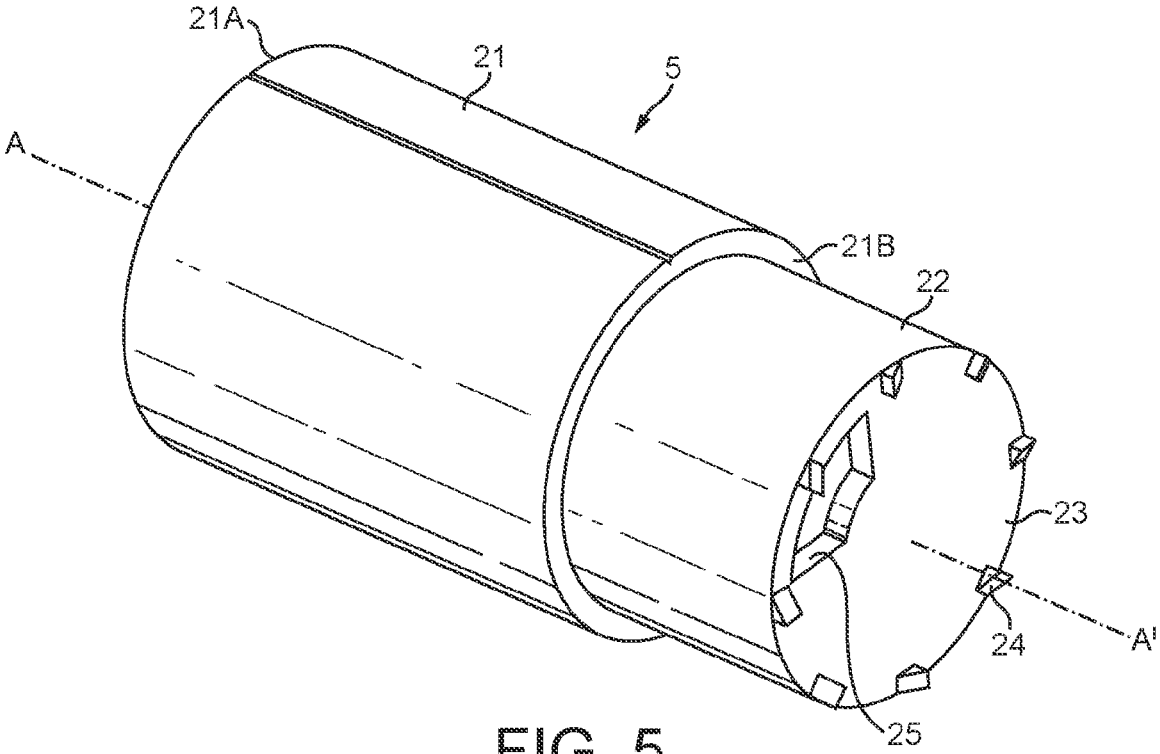
FIG. 5 is an enlarged, flipped over perspective view of a third, mouth end body portion illustrated in FIG. 2.
Figure 6:
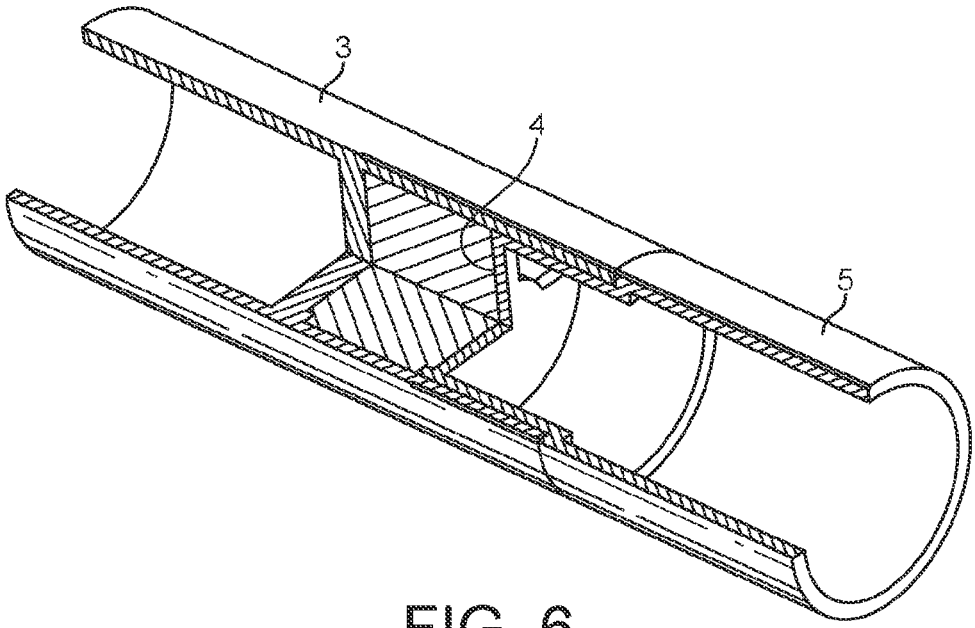
FIG. 6 is a partially broken away view of the device of FIG. 2 when assembled.

The third body portion 5 is illustrated in more detail in FIG. 5 and includes a main, generally cylindrical main wall 21 which may be of the same exterior diameter as the wall 9 of the first body portion. The wall 21 extends from proximal end 21A to a lip 21B that connects to a wall portion 22 of reduced diameter that fits inside chamber 12 of the first body portion. Diametrically extending distal wall 23 is formed with wedge shaped teeth 24 that cooperate with the recesses 20 illustrated in FIG. 4 on the second body portion 4. An aperture is formed in the distal wall 23 to act as a gas flow passageway 25, permitting smoke to flow to the consumer at the distal end 21A through filter plug 7 illustrated in FIG. 1, after having passed through a selected one of the quadrants 18 illustrated in FIG. 4.

The third body portion 5 is provided with a lip (not illustrated) that allows the wall portion 22 to be retained in the cavity 12, with the second body portion 4 sandwiched between the wall 10 of the first body portion 3 and wall 23 of the third body portion 5.

The teeth 24 on the third body portion 5 cooperate with the recesses 20 on the second body portion 4 to provide a second ratchet mechanism which acts in the manner of a free-wheel so that the third body portion 5 can rotate the second body portion 4 in the direction of arrow X illustrated in FIG. 4, but rotation of the third body portion 5 in direction Y opposite to arrow X permits rotation of the third body portion relative to the second body portion. The second ratchet mechanism 20,24 also produces an audible clicking sound, with four clicks being produced for a 90° rotation of the third body portion 5 relative to the second body portion 4.

Figure 7:
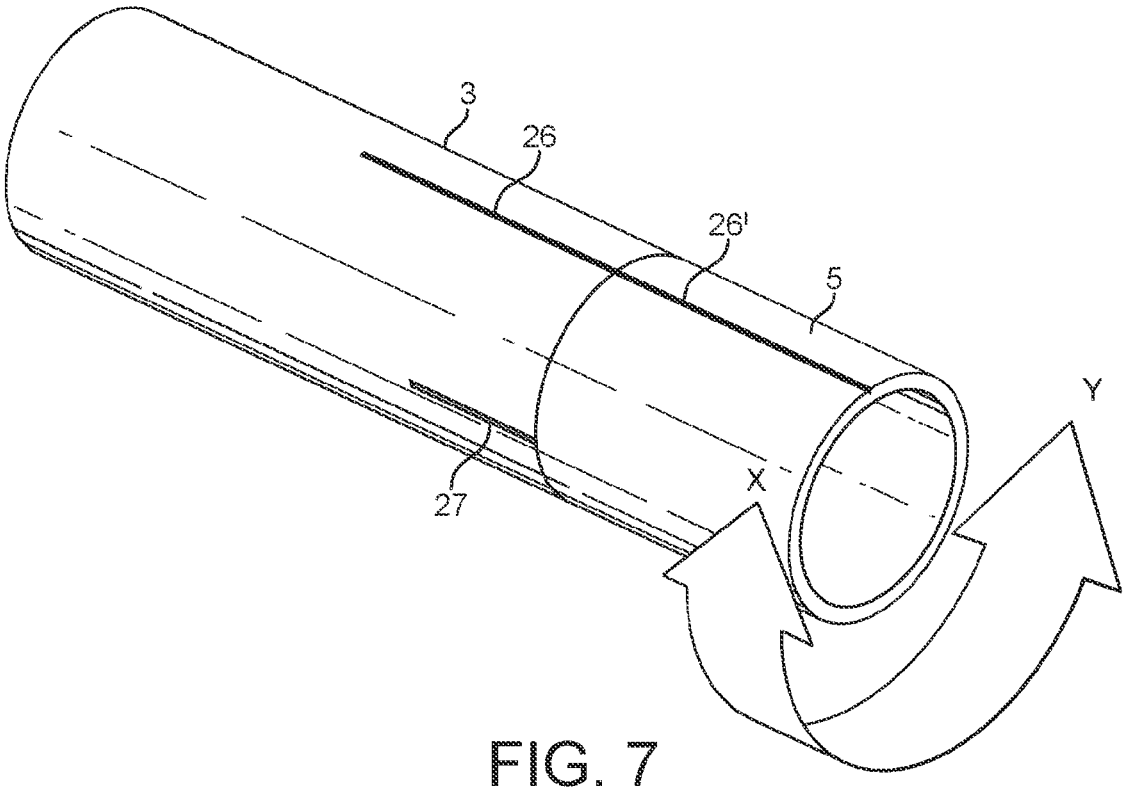
FIG. 7 illustrates a schematically operation of the flow control device.

The device is operated as illustrated in FIG. 7. The device is initially assembled as illustrated in the Figures, with the open quadrant 18-4 that contains no flavourant, aligned with the passageway 13 in wall 10 of first body portion 3, and also aligned with passageway 25 of the third body portion 5. Thus, smoke drawn from the tobacco rod 1 by the consumer flows through the open segment 18-4 and no flavour is imparted to the smoke. Thereafter, the third body portion 4 is turned through 90° clockwise as illustrated in FIG. 7 by arrow direction X followed by 90° anticlockwise in the direction of arrow Y in order to align the quadrant 18-3 with the gas flow passageway between apertures 13, 25. The 90° movement in the direction of arrow X can be determined by listening for four clicks of the first ratchet mechanism and the corresponding return, anticlockwise movement can be ascertained by listening for four clicks of the second ratchet mechanism when rotated in the direction of arrow Y. Also, the various quadrants may be marked on the exterior of the flow control device 2 by marker lines 26, 26' that are aligned in the initial configuration of the device and quadrant defining markers 27. Such markers can be arranged to indicate to the user when a 90° rotation has occurred.

The process can then be repeated to align the flavourant from quadrant 18-2 with the gas flow passageway and a third time to align quadrant 18-1 with the passageway to allow the user to select the different flavourants in the three flavourant-containing quadrants.

Whilst in the foregoing description, three different flavours are described, instead, an individual flavour may be provided in different strengths for the different quadrant to allow the user to select different flavourant strengths.

The flow control device 2 may be used also to produce a different gas flow modification for the flow through the device, for example to introduce different filtering materials such as activated charcoal or other selected filter materials into the gas flow passageway 13, 25.

As used herein, the terms "flavour" and "flavourant" refer to materials which, where local regulations permit, may be used to create a desired taste or aroma in a product. They may include extracts e.g., licorice, hydrangea, Japanese white bark magnolia leaf, chamomile, fenugreek, clove, menthol, Japanese mint, aniseed, cinnamon, herb, wintergreen, cherry, berry, peach, apple, Dramboui, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour masking agents, bitterness receptor site blockers, receptor site enhancers, sweeteners e.g., sucralose, acesulfame potassium, aspartame, saccharine, cyclamates, lactose, sucrose, glucose, fructose, sorbitol, or mannitol, and other additives such aschlorophyll, minerals, botanicals, or breath freshening agents. They may be imitation, synthetic or natural ingredients or blends thereof. They may be in any suitable form, for example, oil, liquid, or powder.

The invention claimed is:

1. A flow control device for a smoking article comprising an elongate body having first, second, and third body portions rotatable relative to one another about a common axis and having a gaseous flow passageway to allow gas to flow along the passageway dependent upon the relative angle of rotation of the body portions about the axis;

a first ratchet mechanism formed by the first and second body portions for controlling manual rotation of the first and second body portions relative to one another about the axis to provide a selected gas flow modification; and a second ratchet mechanism formed by the second and third body portions for controlling manual rotation of the second and third body portions relative to one another about the axis to provide a selected gas flow modification, wherein said ratchet mechanisms comprise cooperating peripheral teeth and peripheral recesses in the body portions.

2. The flow control device according to claim 1 wherein at least one of the ratchet mechanisms is configured to allow manual rotation of the body portions about the axis to a selected angle and to retain the body portions at the selected angle to provide the selected gas flow modification.

3. The flow control device according to claim 1 wherein at least one of the ratchet mechanisms allows unidirectional rotation of the body portions relative to one another and produces a succession of audible clicking sounds during rotation.

4. The flow control device according to claim 3 wherein the clicking sounds each denote relative rotation of the body portions through a predetermined angle.

5. The flow control device according to claim 1 wherein the second body portion includes different sectors configured to produce at least one different gas flow modification along the passageway.

6. The flow control device according to claim 5 wherein said at least one different gas flow modification comprises a modification of the flavor thereof.

7. The flow control device according to claim 1 wherein the second body portion includes a plurality of different sectors that contain different flavorants for tobacco smoke such as to provide at least one different gas flow modification by modifying the flavor thereof.

8. The flow control device according to claim 6 wherein said sectors comprise quadrants, three of which contain respective different flavorants and the fourth of which contains no flavorant.

9. The flow control device according to claim 1, wherein the ratchet mechanisms allow unidirectional rotation of the second body portion relative to the first body portion in a first hand and unidirectional rotation of the third body portion relative to the second portion in a second, opposite hand.

10. The flow control device according to claim 9 wherein the second body portion is arranged to be rotated relative to the first body portion when the third body portion is rotated in a first direction and wherein the third body portion is arranged to be rotated relative to the first and second body portions when the third body portion is rotated in a second direction opposite to the first direction.

11. The flow control device according to claim 1 including a smoking article filter received in the first body portion.

12. The flow control device according to claim 1 including a tobacco rod coupled to the first body portion.

13. The flow control device according to claim 1 wherein said body portions are generally tubular and of molded plastics material.

14. The flow control device according to claim 7 wherein said sectors comprise quadrants, three of which contain respective different flavorants and the fourth of which contains no flavorant.

* * * * *